United States Patent [19]

Bors et al.

[11] Patent Number: 4,845,964

[45] Date of Patent: Jul. 11, 1989

[54] PROCESS FOR THE CONTINUOUS APPLICATION OF LIQUORS ON TEXTILE FIBER WEBS

[75] Inventors: Hans Bors, Fällanden; Albert Goetz, Limmat; Martin Schwemmer, Urdorf, all of Switzerland

[73] Assignee: Triatex International AG, Switzerland

[21] Appl. No.: 182,483

[22] Filed: Apr. 15, 1988

[30] Foreign Application Priority Data

Apr. 16, 1987 [EP] European Pat. Off. ..... 87810239.1

[51] Int. Cl.[4] ..... D06B 1/10; D06B 3/18

[52] U.S. Cl. ..... 68/4; 68/9; 68/202

[58] Field of Search ..... 68/4, 9, 202

[56] References Cited

U.S. PATENT DOCUMENTS

| | | | |
|---|---|---|---|
| 1,715,818 | 6/1927 | Custers | 68/202 |
| 2,410,415 | 11/1946 | Jones | 68/202 X |
| 2,615,381 | 10/1952 | Haefeli | 68/202 X |
| 2,795,839 | 6/1957 | Seawell | 68/202 X |
| 3,036,359 | 5/1962 | Cocker, III | 68/202 |
| 3,098,370 | 7/1963 | Poole et al. | 68/202 X |
| 3,862,553 | 1/1975 | Schwemmer et al. . | |

*Primary Examiner*—Frankie L. Stinson

*Attorney, Agent, or Firm*—Ostrolenk, Faber, Gerb & Soffen

[57] ABSTRACT

The process and apparatuses for the continuous application of liquors to a moving textile fiber web by the methods of metering roller application or pad mangle application, to be selected and changed-over at will. Elements of one application mode are also used, with other functions, for the other mode. The textile web need not be withdrawn from the apparatus and reintroduced along another path during or after change-over from one mode to the other.

7 Claims, 2 Drawing Sheets

PROCESS FOR THE CONTINUOUS APPLICATION OF LIQUORS ON TEXTILE FIBER WEBS

BACKGROUND OF THE INVENTION

This invention belongs to the field of textile finishing means of liquors which contain textile fiber treatment agents. It refers especially to the continuous application of liquors, particularly treatment or, finishing liquors including dyeing liquors, on advancing textile fiber webs where these liquors are absorbed. The invention is furthermore related to apparatuses for carrying out the process.

A plurality of processes and working techniques are already known in the field of textile processing which allow the application of liquors or bathes on textile material webs. In a manner known per se, the term "web" means a textile material which is absorptive for liquids and whose length, compared to its width, is very great, for example 500 to 10,000 times the width, the latter typically not exceeding about 3 meters. The thickness of the material is normally comprised between one and about ten times the diameter of the fibers or filaments forming said textile material. This term therefore comprises woven and knitted fabrics, other non-woven materials such as vleeces, and furthermore also rows or sheets of parallel warp yarns which are to be sized or dyed before weaving. In the latter case, the thickness of the web may be greater than ten times the yarn diameter.

Examples of such liquor application methods are padding, slop padding, the different impregnating techniques, spraying, liquor application which sponges, application of foam and printing; in most cases it is necessary or advantageous to first apply an excess of liquor and then to remove said excess.

An important liquor application method which guarantees a homogeneous impregnation of the web, is the pad mangle technique. In this method, the textile web is offered as much as liquor it will absorb, and the excess of liquor is then removed between squeezing rollers. It is impossible to remove any liquor below the so-called water retention value of the textile material. When technically reasonable squeezing pressures are used, the amount of liquor remaining in the textile material is greater than that limiting value.

The pad mangle technique may be put into practice in different ways, see. e.g., Peter, Grundlagen der Textilveredlung, Dr. Spohr editor, 10th ed., 1970, p. 56 and following, or other manuals of textile processing. These techniques and methods are known to the man skilled in the art. Generally, one proceeds in the following manner: A dry textile web or an already liquor containing web is fed through a trough containing the liquor to be applied. The soaked textile material is then passed in a squeezing roller device where the excess of soaked liquor is removed. It is also possible to pass the textile web to be padded vertically from above through the roller nip of a horizontal squeezing device and to fill the liquor to be applied into the space above the two squeezing rollers. This will result in the presence of a wedged shaped liquor pool or liquor gore at both sides of the textile web just before it enters the roller gap, said liquor supply being of course maintained to replace the amount currently taken up by the textile web.

The particulars and difficulties of the pad mangle technique are known to the man skilled in the art. In particular, the control of the liquor amount to be applied is only possible within relatively narrow limits and can only be achieved via the liquor composition or concentration and/or the squeezing pressure of the squeezing rollers. Nevertheless, pad mangling has advantages in many impregnating processes and is carried out until now, the devices being continuously improved.

A further, important method for the application of liquors, particularly of finishing liquors, on textile material webs is the so-called MA process (MA stands for minimum application) introduced in the '70s. This process allows a homogeneous, controlled and sub-excess impregnation of textile webs with increased working speeds. It is disclosed, as well as a preferred apparatus for its performing, in U.S. Pat. Nos. 3,862,553 and 3,822,834, respectively, and does not need any squeezing device. The process in now introduced in a worldwide scale, is perfectly well known in the field of textile finishing, and need not further be described here.

Although the MA process has been known as a minimum application process, it may also be used for the application of higher amounts of liquors in a controlled, metered and homogeneous manner. This alternative method will be designed in the following, comprising also the minimum application, as "metering roller application".

It has been found, some time ago, that it would be highly desirable for a number of cases to develop a process and an apparatus allowing the operation of pad-mangling as well as the metering roller application, in one and the same machine assembly.

A solution of this problem which appears to be within the ordinary skill of the textile engineer, has already been proposed by the applicants. This solution comprises the successive arrangement of a pad mangle and a metering roller device in one machine frame. One of the two devices may thus be used at will. However, this solution has some serious drawbacks. Firstly, when the change from one to the other application device is desired, the textile web must be cut, drawn completely out of the machine, and be introduced freshly from the infeed end of the machine into and through the other one of the said two applicator devices. This procedure is necessary since the impregnated textile web cannot be allowed to touch any other rollers, not used for the particular, selected application method, before entering the drying section. Secondly, it is expensive and therefore uneconomical to provide two fully separated applicator devices together with the necessary, complex auxiliary and secondary devices, one of these apparatus assemblies being always out of operation; therefore, this solution could not be introduced commercially.

SUMMARY OF THE INVENTION

There is a first and major object of this invention to provide a process for the application of liquors, especially treating and finishing liquors, to a continuously moving textile web wherein the above discussed drawbacks are avoided and which allows to freely select between pad mangle application and metering roller application.

Another object of the invention is to provide such a process wherein the change from one to the other application method may generally be effected without the necessity of a new introduction of the textile web.

A further object of this invention is to provide a process as depicted above wherein the results of both pad mangling and metering roller applications, in terms of the quality of the finished textile web, are improved and the overall efficiency is enhanced.

Still another object of the invention is to provide apparatuses and machines in which the above mentioned process can advantageously be performed.

Other and more specific objects, as well as the novel features of this invention, will appear thereinafter, firstly from the general definition and discussion of the invention and then from the description of preferred embodiments thereof.

Now, the above object and still others are implemented by the process of this invention which comprises feeding the textile fiber web, in order to effect a liquor application either by pad mangling or by a continuously controllable metering roller application, into an apparatus in which elements of said two application devices are combined to one sole application device allowing a selective liquor application by one of the two said application techniques.

Thus, the basic idea of the invention is to combine the two different applicator devices in such a manner that at least part of their elements may be used in the one or the other application method. This implies a different function of these common elements, depending on the selected application method. Preferably, the elements of the combined apparatus are arranged in such a manner that the change-over from one application method to the other will be possible without withdrawing and reintroducing of the textile web.

Further process features are defined in dependent process claims. Furthermore, the invention comprises different apparatuses for carrying out the process, which will be described later.

The invention brings about a plurality of advantages. Thus, the changeover from one application technique to the other is simple and rapid. Then, parts or elements which can be used for either application method are provided only once. The passageway of the textile web through the apparatus is less complicated. It has furthermore be found that, quite surprisingly, the monitoring of the applied amounts of liquor which is essential to the MA method, but which has not been applied before to the pad mangle method, improves the operation of the pad mangle. This will now be explained.

It is known and has already been mentioned that, in the pad mangle, only a relatively small range of applied quantity of liquor (pickup) can be controlled. For this reason, the pickup has not been measured so far, and the pad mangle has been operated typically with the highest possible squeeze roller pressure. Now, it has been found that, when the pickup is measured, that the measuring signal, averaged over the width of the web, can be used for the control of the squeeze rollers of the pad mangle. This allows to keep the effective pickup constant in the case of varying water contents of the incoming textile web. If the pickup is measured stepwise transversely over the web, stripes of unequal pickup can be detected and eliminated by a corresponding variation of the pressure of the squeeze rollers which should be, in this case, segmented rollers. The determining of the pickup and the humidity in the travelling web is made by flying, contact-free devices with the aid of radiations, as it is well known in the art. Typically, the basic weight of the web is measured, i.e. the weight per unit of surface, e.g. in grams per square meter.

In the process of the invention, the textile web to be impregnated is first introduced, in a known manner, into a feeding device. Such devices are known and either comprise two rollers forming a roller nip, one of the rollers or both being positively driven, or comprise a single roller having an anti-skid surface, which is contacted by the web over an angle of at least 180°.

After liquor application, the textile web is fed into a dryer which may be a tenter frame, or is passed to other process stages such as a cold dwell process. Such process steps do not belong to this invention and will not be mentioned herein.

BRIEF DESCRIPTION OF THE DRAWINGS

The instant invention will become more fully understood from the detailed description of preferred embodiments thereof, given hereinbelow, and the accompanying drawings which are given for illustration purposes only and thus are not limitative of the invention.

In the drawings, all FIGURES are partly sectioned schematical side elevations of the apparatuses of the invention.

All FIGURES are schematical representations only for roughly showing the web travel. Same reference numerals refer to identical or equivalent elements. The process of the invention will be understood from the drawings and the following description.

DESCRIPTION OF THE PREFERRED EMBODIMENTS

Figure 1:
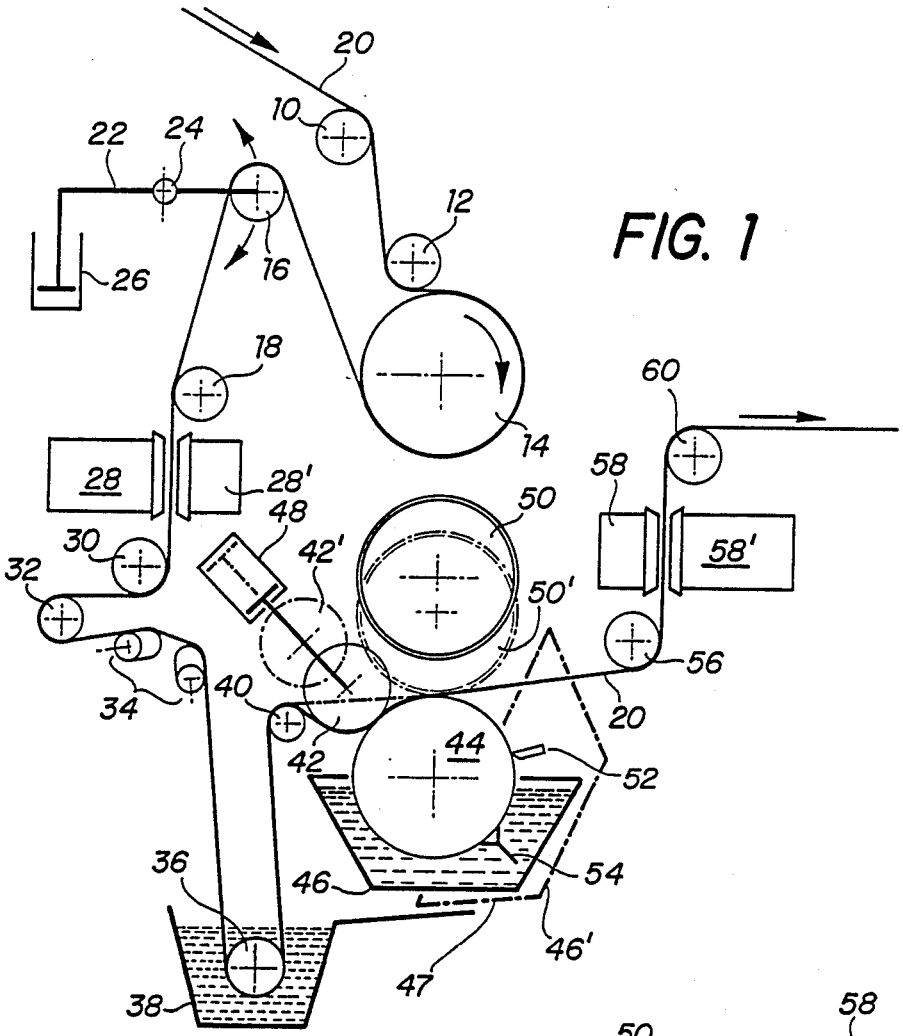
FIG. 1 shows a first embodiment.

A first embodiment of the apparatus of the invention is schematically shown in FIG. 1. Auxiliary devices such as circulation or feeder pumps, liquor containers, machine frames and supports, motors, control units, computers etc. are not shown; they are known to the one skilled in the art.

The apparatus of FIG. 1 is equipped with a web feeding device represented by rollers 10, 12, 14, 16 and 18. The rollers 10, 12 and 18 are small, free-running deflection rollers. The incoming textile web 20, e.g. from a wound-up supply (not shown), passes the deflector rollers 10 and 12 and surrounds the driven feeder cylinder 14 having an anti-skid surface, by about 270°. A compensator roller 16, pivotally journalled in a lever 22 with the fulcrum 24, guarantees a constant web tension. The vertical movements of the roller 16 are cushioned by the hydraulic or pneumatic cylinder-piston assembly 26 which may also be used to position the roller 16. The web then passes through the contact-free measuring unit 28, 28' which measures the basic weight and the humidity content of the web; a display (not shown) indicates the square meter weight of the web. The web 20 then contacts the deflector rollers 30 and 32 and is fed to the arcuated rollers 34 which will smoothen the web and spread out any wrinkles. The arcuated rollers 34 are normally necessary for knitted fabric webs and are generally not required for stronger fabrics such as shirt fabrics; they are neither required for pad mangle operation and may therefore be arranged for being removed from the travelling path of the web 20.

The textile web then goes to and around the padding roller 36 is journalled for rotation in the trough 38 and rotates therein a known manner. The web is then deflected by the roller 40 and enters the nip between a tangential roller 42 and a liquor metering applicator roller 44 which is driven and is journalled for rotation in a trough 46. The tangential roller 42 is provided with a smooth, resilient surface layer and may be pressed against the applicator roller 44, held in a constant distance from that roller, or even completely retracted into the upper end position 42' shown in dashed lines in FIG. 1, by the hydraulic or pneumatic motor 48.

The metering roller device used here and which serves particularly for the minimum application, is an invention of the applicants and shown and described in all details in U.S. patent specification No. 4,672,705. This patent is incorporated into this description by reference. The description, therefore, will not be repeated here.

The ductor blades 52 and 54 act as cleaning devices to keep clean the liquor in trough 46, and for establishing a bubble-free liquor film on the surface of the applicator roller 44.

A lowerable, driven counter-roller 50 is mounted above the applicator roller 44. Its function will be described later.

The textile web leaves the applicator roller and passes over the deflector roller 56, through a second basis weight measuring unit 58, 58', and over a further deflector roller 60 to leave the apparatus of the invention.

The MA operation mode (i.e. the metering roller application) is shown in FIG. 1 in plain lines. The detailed process operation is fully described in the U.S. patent specification No. 4,672,705 mentioned above.

Should the apparatus be operated in the pad mangle mode, the following changes are made which can be performed in a few seconds; it is not necessary to stop the advance of the textile web completely. A computer program control can be used for these changes:

1. The tangential roller 42 is raised into its position 42'; the trough 46 is emptied.

2. Liquor is charged into the trough 38; simultaneously, trough 46 is pivoted into position 46', and the upper squeezing roller 50 is pressed against the applicator roller 44 which now serves as the lower squeezing roller.

3. The upper rollers of the arcuated roller system 34 are raised, and the doctor blades 52, 54 are retracted. Rollers 50', 44 now form the squeeze roller unit of a pad mangle unit, together with the padding system 36, 38. The liquor squeezed out by the rollers 50, 44 flows by its own over the inclined front edge 47 of the trough 46' into the padding trough 38. The textile web 20 travels between the deflector roller 40 and the nip of the rollers 50', 44 along the dashed line.

In this embodiment, the pad mangle squeezing device cannot be used during the MA operation mode since the MA applicator device is used for squeezing.

Figure 2:
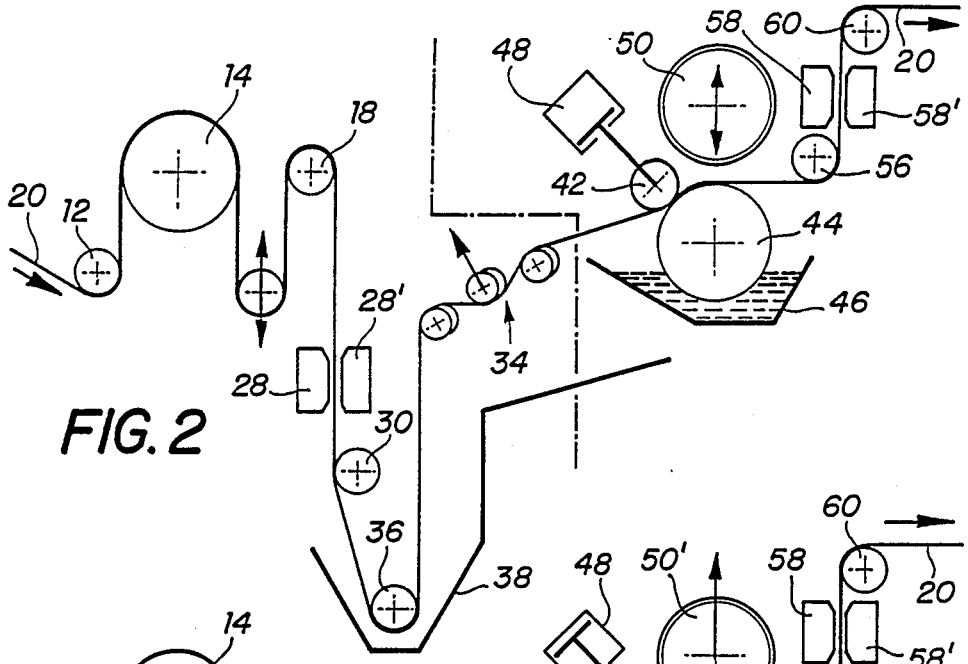
FIG. 2 represents a second embodiment, shown in metering roller operation mode.
Figure 3:
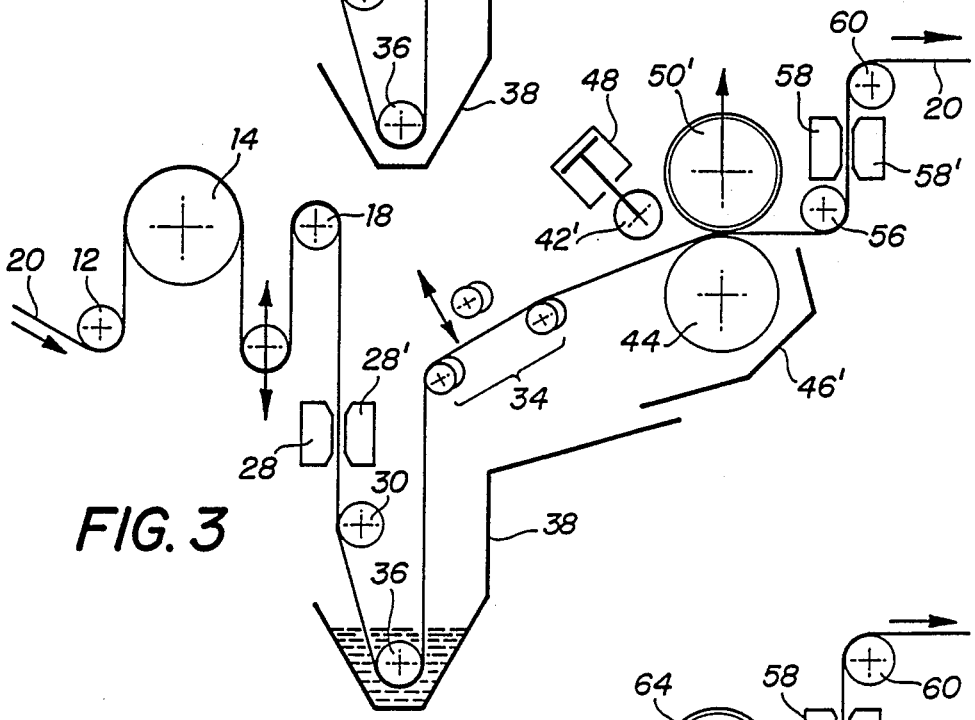
FIG. 3 represents the embodiment of FIG. 2 shown in pad mangle operation mode.

A further embodiment of the process and the apparatus is shown in FIGS. 2 and 3. The following elements and units have already been described with reference to FIG. 1: Deflector rollers 12, 18 and 30; the feeder roller 14; the web tension compensator 16; the input basis weight measuring unit 28, 28'; the arcuated roller system 34 with its upper rollers capably of being raised; the padding trough 38 with the padding roller 36; the tangential roller 42 with its fluid motor 48; the MA applicator roller 44, the trough 46, the counter-roller 50; the output basis weight measuring unit 58, 58', and the output deflector rollers 56 and 60. The difference with respect to the embodiment of FIG. 1 is that the arcuated roller system 34 which is not required in the pad mangle mode, is provided downstream the pad mangle and immediately before the MA device. This arrangement permits the smoothing and spreading of the web 20 and the tightly stretched condition of the web immediately before touching the tangential roller 42.

The angled, dashed line in the middle of FIG. 2 will be explained with reference to FIGS. 4 to 6.

FIG. 3 shows the operation of the apparatus after the change-over to the pad mangle mode. All changes correspond to those shown and described with respect to FIG. 1 and need therefore not be repeated.

Figure 5:
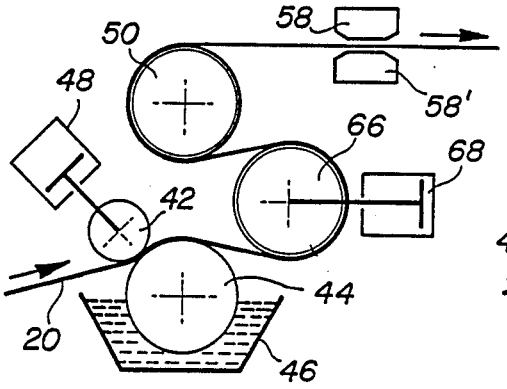
FIG. 5 shows a fourth embodiment which replaces the right-hand portion of FIG. 2, separated by dashed lines, and is thus used together with the remaining elements of FIG. 2, and is shown in metering roller operation mode, and FIG. 6 the device of FIG. 5 in pad mangle operation mode.
Figure 6:
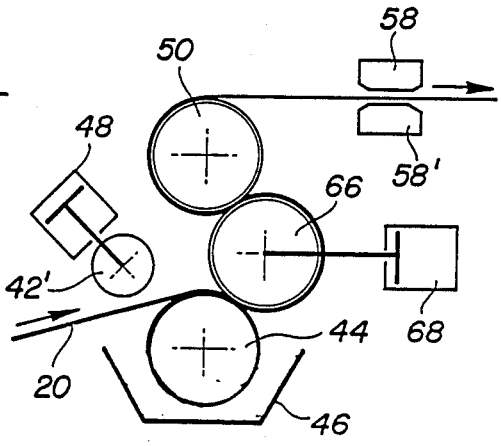
Figure 4:
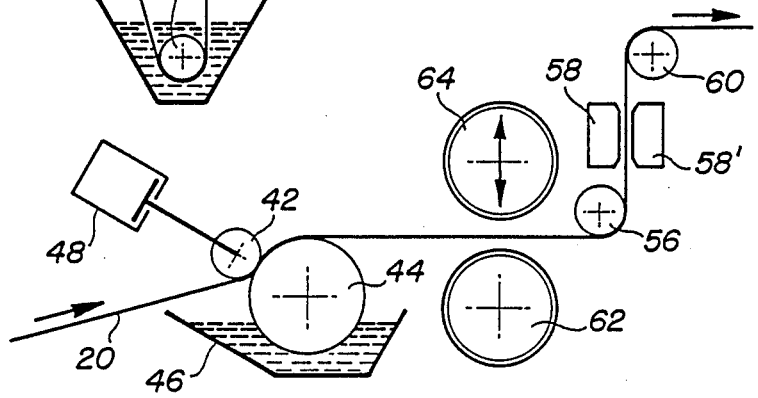
FIG. 4 shows a third embodiment.

In FIGS. 4 to 6, only a portion of the apparatus represented in FIG. 2 is shown, namely the section right-handed to the angled broken line. The elements and units in the left-hand portion of FIG. 2 remain the same for FIGS. 4 to 6.

According to FIG. 4, the apparatus has been completed by a squeezing unit comprising the rubber layered rollers 62 and 64. The upper roller 64 is arranged for being raised from the textile web 20, whereas in FIGS. 1 to 3, one of the squeezing rollers (44) is of steel. The lower roller 62 is fixed against a vertical motion and mounted in such a manner that, when the upper roller is raised into the position shown in FIG. 4, the textile web 20 comes free from the lower roller 62.

The roller pair 62, 64 is always used in the pad mangle mode. The trough which will collect the squeezed out excess liquor and which is mounted below the roller 62, is not shown. In the MA operation mode, the rollers 62, 64 are not used as it is shown in FIG. 4.

A further and interesting embodiment of the apparatus of the invention is shown in FIGS. 5 and 6. This embodiment is based on the idea to use the applicator roller of the metering roller application system which is required to be present anyway, for the second stage of a double-acting squeezing device.

For this purpose (FIG. 5), a horizontally displaceable press roller 66 is mounted laterally and upwardly with respect to the metering applicator roller 44. The diameter of the press roller 66 is greater than the axial distance of the applicator roller 44 from the upper counter-roller 50 (see FIG. 1). The press roller 66 can be pressed against the counter-roller 50 and, simultaneously, the applicator roller 44 by the action of pneumatic cylinder 68. The press roller 66 and the counter-roller 50 are provided with a rubber layered surface. The squeezing of the excess liquor during the pad mangle operation mode is effected in the nip of the rollers 50 and 66 (FIG. 6), a preliminary squeezing being already brought about in the nip between the rollers 44 and 66. This device therefore acts as a three-roller pad mangle.

Should the device be operated in the metering roller application mode, it is changed as shown in FIG. 5.

It should be added that the applicator roller 44 is rotated, in the metering roller application method, in such a manner that its surface speed is slower than the travelling speed of the textile web 20. The liquor film on the surface of the applicator roller is not influenced from outside, e.g. by a doctor blade. The circumferential speed of the applicator roller determines the applied liquor amount and is controlled with respect to the travelling speed of the textile web.

The devices described in the foregoing are not to be construed as to mention all possibilities to put the process of the invention into practice. The apparatuses may be modified by obvious variants. For example, the roller pressure may be generated by other means than hydraulic or pneumatic cylinders—the latter are presently preferred—, e.g. by spring presses.

The new process and the described apparatuses allow a universally useful impregnation of all textile material webs, made from a variety of materials selected from natural and man-made fibers and their mixtures, using any aqueous or non-aqueous liquor, and they permit the realization of homogeneous, metered and reproducible liquor applications.

The apparatuses of the invention may be used to perform the following finishing methods of textile materials; the composition of the corresponding treatment liquors is known to the man skilled in this art:

Non-iron finishing,
shrink-proof finishing,
stiffening,
dyeing, particularly with pigments and reactive dyestuffs,
sizing,
softening,
hydrophobing,
water drop-proof finishing,
anti-fouling finishing,
soil-proof finishing,
oleophobing,
wrinkle-proof finishing,
lustering (chintz),
flame-proof finishing
antistatic finishing,
felt-proof finishing,
anti-mite finishing,
decatizing,
effect finishing.

What we claim is:

1. An apparatus for carrying out a process for the continuous application of liquors on textile fiber webs, comprising:

(A) a textile web spreading and equalizing device,
(B) a padding roller,
(C) a combined metering roller and squeezing device downstream from the padding roller, said squeezing device comprising a tangential roller cooperating with said metering roller in a metering roller application mode, said metering roller being rotatably journaled in a pivotable liquor trough in the metering roller application mode, said tangential roller being retracted and said pivotable trough being pivoted in a pad mangle application mode, and
(D) a counter-roller being mounted above said metering roller and pressed against the metering roller in the pad mangle application mode, and wherein said metering roller is a lower squeezing roller and, together with said counter-roller, forms a squeezing device.

2. The apparatus of claim 1, wherein said textile web spreading and equalizing device comprises a plurality of arcuated rollers disposed upstream from said padding roller.

3. The apparatus of claim 1, wherein said textile web spreading and equalizing device comprises a plurality of arcuated rollers disposed downstream from said padding roller, at least part of said arcuated rollers being mounted for retraction from the impregnated textile web.

4. The apparatus of claim 1, further comprising the measuring devices for determining the basic weight of the said textile web, one measuring device being provided upstream from a first liquor application element and another measuring device being provided downstream from a second liquor application element.

5. The apparatus of claim 4 wherein the said devices for determining the basic weight of the textile web are contact-free devices based on radiation.

6. The apparatus of claim 4, further comprising control means for controlling the squeezing pressure of said combined metering roller and squeezing device in the pad mangle operation mode or for controlling the rotational speed of said metering roller in the metering roller application mode, said control means being arranged for processing signals coming from said basic weight measuring devices.

7. An apparatus for carrying out a process for the continuous application of liquors on textile fiber webs, comprising:

(A) a textile web spreading and equalizing device;
(B) a padding roller for use in a pad mangle application mode;
(C) a metering roller application device downstream from said padding roller, said metering roller application device comprising a metering roller; and
(D) a pad mangle squeezing device, said pad mangle squeezing device being constructed as a double-acting squeezing device, said double-acting squeezing device comprising:
(1) said metering roller;
(2) a counter roller; and
(3) a press roller, said press roller having a diameter which is greater than the distance between said metering roller and said counter-roller, said press roller being adapted to be pressed against both said metering roller and said counter-roller, and said press roller being adapted to be retracted to a position free from contact with said metering roller and said counter-roller.

* * * * *